United States Patent [19]

Goddard et al.

[11] 4,080,902

[45] Mar. 28, 1978

[54] HIGH SPEED IGNITER DEVICE

[75] Inventors: Terrence P. Goddard, Aptos; Samuel D. Webb; Donald N. Thatcher, both of Hollister, all of Calif.

[73] Assignee: Teledyne McCormick Selph, Hollister, Calif.

[21] Appl. No.: 738,763

[22] Filed: Nov. 4, 1976

[51] Int. Cl.[2] ..... F42B 3/10

[52] U.S. Cl. ..... 102/70 R; 102/27 R; 149/22

[58] Field of Search ..... 149/22; 102/27 R, 70 R

[56] References Cited

U.S. PATENT DOCUMENTS

| | | | |
|---|---|---|---|
| 3,041,914 | 7/1962 | Gurton et al. | 102/27 R |
| 3,107,613 | 10/1963 | Armstrong et al. | 149/61 |
| 3,320,882 | 5/1967 | Schulz | 102/27 R |
| 3,389,659 | 6/1968 | Cassidy et al. | 102/27 R |
| 3,667,391 | 6/1972 | Amiable | 102/70 |
| 3,851,586 | 12/1974 | Eller et al. | 102/70 R |
| 3,903,800 | 9/1975 | Kilmer | 102/27 R |
| 3,945,322 | 3/1976 | Carlson et al. | 102/27 R |
| 4,023,493 | 5/1977 | Austin et al. | 102/27 R |
| 4,024,817 | 5/1977 | Calder et al. | 102/27 R |

*Primary Examiner*—Edward A. Miller

*Attorney, Agent, or Firm*—David H. Semmes; Warren E. Olsen

[57] ABSTRACT

An ignition device in the form of a linear member which has an internal linear propagation characteristic of a detonation, but a radial heat and gas evolution characteristic of a very fast deflagrating pyrotechnic material not accompanied by a shock or detonation wave. The device uses a central core containing an encapsulated explosive with a surrounding layer, or discrete layers, of a metal-clad pyrotechnic material that is significantly characterized by a class of compounds that are specific simple decahydrodecaborate salts containing the common anion $B_{10}H_{10}^{-2}$. The outer cladding materials themselves do not functionally ensure a radial deflagration; rather the specific pyrotechnic materials employed ensure a radial deflagration. There are taught specific relationships for components, and a necessary radial compaction.

64 Claims, 6 Drawing Figures

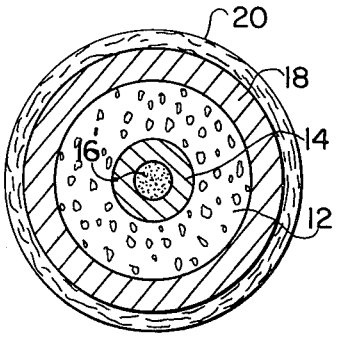
FIG. 2
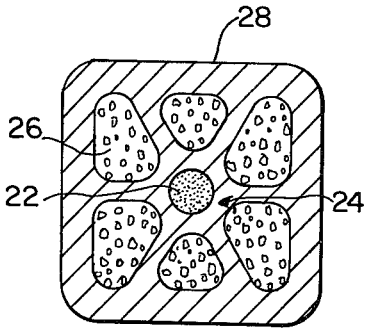
FIG. 3
FIG. 5
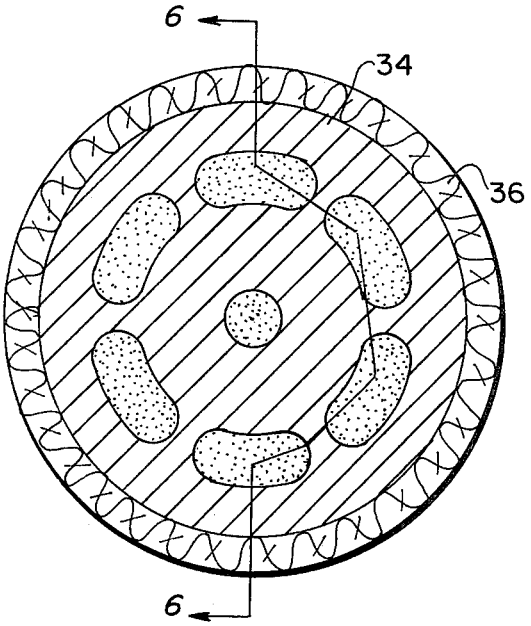
FIG. 6
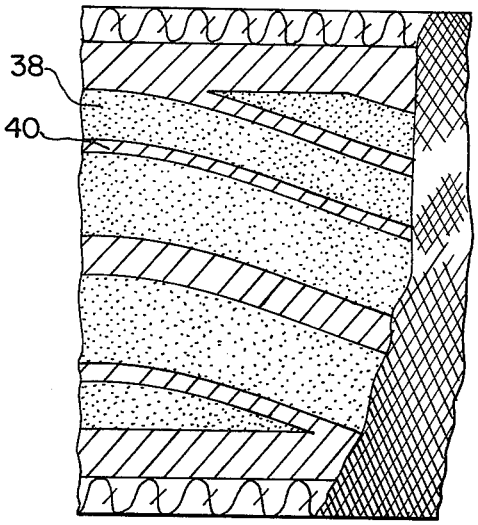

HIGH SPEED IGNITER DEVICE

BACKGROUND AND SUMMARY OF THE INVENTION

For many applications, it is necessary to nearly simultaneously apply heat and gas over an extended area, for example, in the ignition of a mass of propellant or over a surface to accomplish mechanical work. This near simultaneous ignition is best accomplished by a source with a very fast propagating speed, that is, by a stimulus with a propagating velocity characteristic of a detonation, 5000 to 8000 meters per second. For the same applications, however, it is often required that the source of heat and gas which actually performs the function, for example, ignites the propellant or provides a force against a surface, be a "soft" or nondetonating stimulus. Although a detonation might provide adequate heat and gas to accomplish the intended purpose, the accompanying detonation wave cannot be tolerated because of the mechanical impulse applied to the surrounding volume. For example, many commonly used rocket or gun propellants are fashioned into complex geometric shapes termed "grains" in order to control the overall burning rate of the propellant mass. A detonation wave impinging on such grains will shatter the grain structure, thus destroying the physical configuration which is necessarily designed into the grain. What is needed, then, for these types of applications, is a device which is capable of transferring a stimulus over an extended region with a very high speed, but whose outward stimulus at the point of ignition or gas evolution is characteristic of a fast deflagration, without an accompanying shock or detonation wave.

BRIEF DESCRIPTION OF THE DRAWINGS

FIG. 2 schematically illustrates a second embodiment of the invention;

FIG. 3 schematically illustrates a third and preferred embodiment of the invention;

FIGS. 4 and 5 schematically illustrate compaction and area reduction according to the principles of the present invention;

FIG. 6 schematically illustrates, in partial section, a spiral pyrotechnic configuration after the area reduction.

DETAILED DESCRIPTION OF THE INVENTION

The subject invention consists basically of a central cord of explosive, that is, material capable of undergoing a detonation, surrounded by an outer layer of a rapidly burning pyrotechnic material, in particular, certain types of compounds based on salts of decahydrodecaboric acid, and manufactured in such a manner that the function of the resulting device accomplishes the desired purpose.

Figure 1:
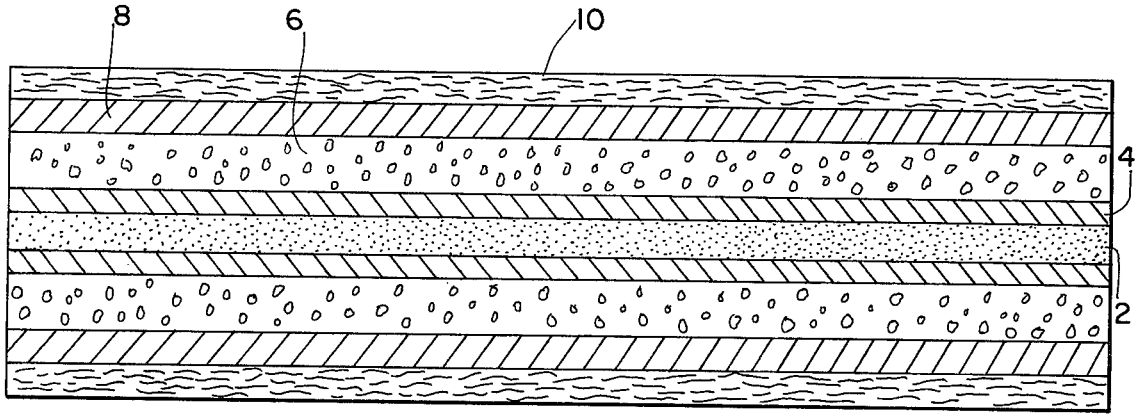
FIG. 1 schematically illustrates a first embodiment of the invention.

A linear cross sectional view of a first embodiment of the invention is shown in FIG. 1. A central core of a detonating explosive, 2, is surrounded by a sheath, 4, which may be metal or one or more layers of fiber or plastic. The central explosive core is surrounded by a pyrotechnic material, 6, selected from a class of salts of decahydrodecaboric acid blended, or coprecipitated with a suitable oxidizer. The pyrotechnic layer is in turn surrounded by a metal cladding 8. The entire assembly is encapsulated by an outer covering, 10, which may consist of metal, plastic, or fabric.

The overall cross-sectional area of the subject device may be of virtually any geometry and depends on the exact method of manufacture. The internal cross-sectional structure may also assume a variety of forms, two of which are represented in FIGS. 2 and 3. In the second embodiment of FIG. 2 a single annulus of pyrotechnic material, 12, surrounds a sheath, 14, which contains a centrally disposed high explosive, 16. A metal cladding, 18, surrounds the pyrotechnic material 12 to allow the cross-sectional area of the entire device to be reduced by a swaging operation. After the intimate compaction of the device, as by swaging, a final outer encapsulment, 20, may be added.

In the third, and preferred, embodiment of FIG. 3, a plurality of individual metal-clad pyrotechnic cords are illustrated to have been compacted over a central explosive cord and into an overall square cross-section, such as by drawing through a succession of square dies. Alternatively, a single wagonwheel spaced metal matrix may have been employed to initially define the central high explosive and the surrounding discrete pyrotechnic sections. In either case, the overall cross-section must be reduced by swaging or drawing in order to ensure an intimate compaction of pyrotechnic with respect to the outer sheath of the detonating cord. In this third embodiment, the explosive core, 22, is sheathed by a concentrically spaced metal region, 24, with each pyrotechnic material segment 26 shown with its cladding, 28, intimately fused to the detonating cord sheathing 24.

In the embodiment of FIG. 3, the fused metal cladding 28 may also function as the encapsulating layer for the device or, optionally, a further metallic, braided or plastic encapsulment may be applied after the area reduction step.

The principle of the device function is that the central cord is detonated with a suitable source, i.e., one which will impart sufficient stimulus to the explosive material to induce a high order detonation in the material. Suitable detonators are conventional in the art, as illustrated hereinafter, and further illustration is not considered necessary to an understanding of the present invention. This stimulus propagates linearly along the central portion of the device with a speed characteristic of the detonating velocity of the detonating explosives preferred for this device, i.e., 5000 to 8000 meters per second. The explosive stimulus ignites the pyrotechnic material as it passes down the center of the cord, by the shock induced into the pyrotechnic material or the flame associated with the hot gases behind the detonation wave, or both.

Pyrotechnic materials useful in the subject device consist of a certain class of decahydrodecaboric acid salts with various oxidizers. They have a very fast deflagration mechanism, but will not detonate. The pyrotechnic material, after being ignited by the detonating stimulus, burns and the hot gases and particles from this deflagration propagate outward in a radial direction with an effective velocity less than that characteristic of a detonation, typically 10,000 inches per second. The shock wave associated with the detonating stimulus is completely absorbed by the cladding and encapsulating layers around the pyrotechnic material, so that a source outside the device experiences only the effects of the deflagrating pyrotechnic, and does not witness a shock wave associated with the detonation. The effective rate of propagation of the deflagrating stimulus in the linear direction, however, is very fast, i.e., that of the detonation front.

The method of manufacturing the devices is critical in that the final geometrical configuration of the device must allow an efficient ignition of the pyrotechnic material. This condition may be stated as a criterion that the pyrotechnic material and the cladding around it be intimately juxtapositioned with the detonating explosive material, through intimate contact with and around the central detonating member. This condition may be achieved if the layers of pyrotechnic material, explosive material, and successive layers of encapsulment are first assembled in loose form and then the cross-sectional area of the loose assembly is reduced until the components are tightly squeezed together.

The device may be further appreciated by a consideration of its significant components, and their interactions, as follows.

DETONATING HIGH EXPLOSIVE CORD

The function of the central explosive cord is to propagate the explosive stimulus at a high linear velocity, and simultaneously ignite the pyrotechnic decahydrodecaborate composition surrounding the cord. In order to accomplish the latter, the explosive must possess sufficient force to shatter the metal separating it from the pyrotechnic, and have sufficient heat output to ignite the pyrotechnic composition.

A convenient method of packaging the said explosive in a cord form to accomplish the intended purpose is to surround the linear explosive in a metal sheath, such as lead, silver, or aluminum, and draw or swage the resulting assembly through a series of dies until the desired distribution of explosive in the resulting cord is obtained. Such a swaging procedure is well known to those practiced in the art. The distribution of explosive is normally measured by the weight of explosives in grains per linear foot of cord; the ratio of the weight of sheathing metal to the weight of explosive per linear foot may be conveniently defined as the "mass ratio." The requirements of the explosive to propagate at the desired speed and ignite the pyrotechnic composition place certain restrictions on the type of explosive, the core load, and mass ratio preferred for the explosive cords useful in this invention.

Preferred explosive materials for the cords incorporated in this invention are materials which have a brisance equal to at least 90% that of trinitrotoluene (TNT), and a heat of explosion in excess of 600 calories per gram. The term brisance reference to the shattering power of the explosive and the heat of explosion refers to the self-contained energy released when the subject material undergoes a detonation; these definitions are elaborated upon in any common reference work on explosives, such as Basil T. Fedoroff, "Encyclopedia of Explosives and Related Items." Representative high explosive materials which have properties satisfactory for the present invention, and which can be readily incorporated into the detonating cords, are cyclotrimethylenetrinitramine (RDX), cyclotetramethylenetetranitramine (beta-HMX), pentaerythritol (PETN), hexanitrostilbene (HNS), and dipicramid (DIPAM).

Preferred sheathing metals for the forementioned explosives are aluminum, silver, and lead, the lead material being especially preferred for the cords useful in this invention. Preferred limits on the explosive distributions and mass ratios of the forementioned explosives in lead sheathed cords useful in this invention are given in Table I.

In general, the higher mass ratios correspond to the lower limits of core load. The mass ratio for a detonating cord does not change during a swaging operation that reduces the core loading, i.e., the detonating cord is elongated, but the total ratio of lead to explosive remains substantially constant for any final outer diameter given to the detonating cord.

TABLE 1

| Explosive | Explosive Distribution (Core Load) Grains per linear foot | Mass Ratio (Ratio of weight of lead to weight of explosive) |
|---|---|---|
| RDX | 2 - 6 | 50- 12 |
| HMX | 2 - 6 | 50 - 12 |
| PETN | 2 - 6 | 50- 12 |
| DIPAM | 4 - 10 | 50 - 15 |
| HNS | 4 - 10 | 50 - 15 |

An alternate embodiment of encapsulation on the explosive particles herein is a flexible, extruded cord consisting of an explosive, with the forementioned properties, bonded with a viscoelastic binder such as nitrile rubber or nitrocellulose. An example of such a flexible cord is described by Evans in U.S. Pat. No. 3,338,764. The core loads of the said explosive in a flexible form are as given in Table I; preferred flexible-type cords for use in this invention may also contain an additional form of explosive encapsulation through a further outer layer of a flexible inert material.

Decahydrodecaborate Compounds

The pyrotechnic compositions taught for use in the present invention consist either of an intimate blend, or a coprecipitate, of certain simple salts of decahydrodecaboric acid with an oxidizing agent, and may optionally include small amounts of other materials such as finely divided metals or small amounts of binder. The key ingredient is a simple decahydrodecaborate salt of a certain class, and these distinguish the pyrotechnic compositions within this invention from other pyrotechnic or incendiary compositions.

The pyrotechnic materials taught for this invention are unusual in that the subject class of pyrotechnic compositions do not exhibit a detonation upon confinement. Normally, the burning of any composition containing a high energy component, such as those employing nitroglycerine or other commercial explosives, black powder, and compositions employing a free metal and oxidizer, such as aluminum and potassium perchlorate, results in a transformation to a detonation under even mild confinement conditions, making them unsuitable for ignition purposes. The compounds of this invention, however, can be formulated to deflagrate uniformly with a very fast rate, but not detonate. Thus, the advantages of extremely high heat and gas output, without the accompanying detonation shock effects, are achieved in the present invention.

The simple decahydrodecaborate salts taught for use herein are compounds of the general chemical formula:

$$M_x(B_{10}H_{10})_y$$

where M is a cation or complex cation incorporating hydrogen, nitrogen, carbon, or metals, or some combination thereof, and is chosen from the list given below; $x$ is the number of M ions; and $y$ is equal to:

($x$ times the valence of the M ion)/2

The compounds may further be defined as certain salts of decahydrodecaboric acid, and thus contain as a common ion the decahydrodecaborate (−2) anion $B_{10}H_{10}^{-2}$.

The cation M is herein defined by the following classes:

A. ammonium, $NH_4+$, wherein the salt has the formula $(NH_4)_2B_{10}H_{10}$, and is described by KNOTH U.S. Pat. No. 3,148,938.

B. hydrazinium, $NH_2NH_3+$, wherein the salt has the formula $(NH_2NH_3)_2B_{10}H_{10}$, and is described by KNOTH U.S. Pat. No. 3,148,938.

C. substituted ammonium cations, wherein the salt has the general formula $(R_3NH)_2B_{10}H_{10}$, where R can be hydrogen (H) or alkyl radical (preferred radicals contain less than six (6) carbon atoms). The R's in the preceding formula may represent different alkyl groups. Compounds with two or three hydrogen radicals are described by KNOTH U.S. Pat. No. 3,149,163. Typical cations are methylammonium $(CH_3)NH_3$, dimethylammonium $(CH_3)_2NH_2$, trimethylammonium $(CH_3)_3NH$, and triethylammonium $(CH_3CH_2)_3NH$.

D. substituted hydrazinium cations, wherein the salt has the general formula $(R_2NNR_2H)_2B_{10}H_{10}$, where R can be hydrogen (H) or an alkyl radical (preferred radicals contain less than six (6) carbon atoms), and the substituted alkyl groups can be symmetric or assymmetric with respect to the N=N linkage. Symmetric substituted cations are described by KNOTH U.S. Pat. No. 3,149,163. An example of an unsymmetric substituted cation is (1,1) dimethylhydrazinium. The R's in the preceding formula may be mixed alkyl radicals.

E. quaternary ammonium salts of the general formula $(R_4N)_2B_{10}H_{10}$, where R is an alkyl radical; the R's in the preceding formula may represent mixed alkyl groups. Examples of typical cations are tetramethylammonium $(CH_3)_4N^+$ and tetraethylammonium $(CH_3CH_2)_4N$.

F. aryl containing cations, such as pyridinium, bipyridinium, or substituted aryl cations, such as aryldiazonium cations.

G. guanidinium ion, $C(NH_2)_3^+$, wherein the salt has the formula $(C(NH_2)_3)_2B_{10}H_{10}$, and is further described in a copending application of common assignment entitled BIS-GUANDINIUM DECAHYDRODECABORATE, filed June 10, 1976, with Ser. No. 694,627.

H. metal ions, derived from metals defined by a Periodic Table such as that in the "Handbook of Chemistry and Physics," 54th Edition, inside front cover, by the elements in Groups 1, 2, 8, 3*b*, 4*b*, 5*b*, 6*b* and 7*b*, and the elements of Groups 3*a*, 4*a*, 5*a*, and 6*a* with atomic numbers greater than 5, 14, 33, and 52 respectively. These metal decahydrodecaborate salts are further described by KNOTH U.S. Pat. No. 3,148,939. Representative examples of such metal salts are $Cs_2B_{10}H_{10}$ and $K_2B_{10}H_{10}$, the simple cesium and potassium salts of decahydrodecaborate acid.

These simple salts of the decahydrodecaborate (−2) ion (chemical formula $B_{10}H_{10}^{-2}$) are conveniently prepared by stoichiometrically reacting an aqueous solution of the parent acid, dihydrogen decahydrodecaborate, $H_2B_{10}H_{10}$, with 1. a soluble hydroxide of the desired cation, such as ammonium hydroxide, 2. the conjugate Bronsted base of the desired cation, such as a free amine, or 3. a soluble salt of the desired cation, such that the salt anion is destroyed during the reaction, such as guanidine carbonate. A Bronsted base is any substance capable of accepting a proton in a reaction; the definition is elaborated upon in any elementary chemistry text, such as Dickerson, Gray and Haight, "Chemical Principles, 2nd Edition," 1974, pg. 135.

The aqueous solutions of the salts, prepared above, may be evaporated to dryness to recover the crystalline salt. Alternately, some salts may be precipitated from the aqueous solution by a nonsolvent that is miscible with water. The salts may be purified by recrystallization.

The aqueous decahydrodecaboric acid used as a starting material for the process of this invention is conveniently prepared by passing an amine or metal salt of the decahydrodecaborate (−2) ion through a column containing a strongly acidic ion exchange resin of the sulfonic acid type, such as "Duolite" type "C-20", acid form (Diamond Shamrock Corporation). Preferred starting salts are bis (triethylammonion) decahydrodecaborate (−2) and disodium decahydrodecaborate (−2). The preparation and properties of the aqueous acid and additional preparative methods for metallic salts are described in more detail in U.S. Pat. No. 3,148,939.

The compositions of this invention make use of the unique decomposition properties of the decahydrodecaborate (−2) ion, a bicapped square antiprism polyhedral ion with unusual stability; the ion is believed to be kinetically rather than thermodynamically stabilized. The ion demonstrates an unusually fast decomposition upon oxidation, which is believed to proceed through the labile apical hydrogen atoms bonded to the cage.

The pyrotechnic compositions contemplated for use within the present invention are conveniently further divisible into two classes, said classes being distinguished by the method of combining the simple decahydrodecaborate salt with the oxidizer.

Class (1)

The compositions of Class (1) consist of intimate physical mixtures of a decahydrodecaborate salt, selected from the forementioned list of such salts, with a finely divided oxidizing agent.

The compositions of this invention are prepared by intimately mixing the finely divided constituents by hand or in conventional mixing equipment. A liquid carrier such as butyl acetate or trichloroethylene may be employed to facilitate mixing or addition of binder; the liquid is subsequently evaporated to yield the dry composition.

The particle size of such decahydrodecaborate (−2) salts are controlled during their preparation of the reaction conditions, method of recrystallization, speed of recrystallization, and optionally, by subsequently grinding and/or sieving, with or without a liquid carrier. The particle size of the oxidizing agent is controlled commonly by grinding to the prescribed particle size, with subsequent sieving. The sieve size for both decahydrodecaborate salt and oxidizer is normally between the limits 40 mesh and 325 mesh (which specifies only the maximum particle size in the mix).

Non-metallic pyrotechnic compositions of Class (1) are further described in detail in a copending application of common assignment entitled IGNITION AND PYROTECHNIC COMPOSITIONS, filed June 10, 1976 and assigned Ser. No. 694,625, which is incorporated herein by reference. Metallic pyrotechnic compositions included within class (1) are further described in Armstrong, U.S. Pat. No. 3,126,305.

Class (2)

The compositions of Class (2) are comprised of an intimate blend of a decahydrodecaborate salt, selected from the preceding list, with an oxidizing agent, in a manner such that a chemically and physically different product is obtained from the starting materials.

The process by which the compositions of this class are prepared produces a very intimate blend of decahydrodecaborate (−2) ion with the oxidizer and makes the compositions so prepared chemically and physically unique from physical blends of decahydrodecaborates (−2) salts with oxidizer or pyrotechnic compositions incorporating decahydrodecaborate (−2) salts produced by other means. In general, the process consists of dissolving, in a suitable solvent, a decahydrodecaborate (−2) salt, as described above, and also dissolving, in the same solution, an oxidizing agent, as described above. The subject composition is recovered by precipitating the composite ingredients of the solution with a suitable nonsolvent. The resulting solid, after filtration and drying, comprises an intimate mixture of the decahydrodecaborate (−2) anion with the oxidizing cation or substance, in a form that is chemically and physically different than the starting materials.

The process may be properly called a "cocrystallization" or "coprecipitation" and the resulting produce a "cocrystallate" or "coprecipitate."

The materials of Class (2) and process for preparing them is described in more detail in a copending application of common assignment entitled COPRECIPITATED PYROTECHNIC COMPOSITION PROCESSES AND RESULTANT PRODUCTS, filed June 10, 1976 as Ser. No. 694,626, which is incorporated herein by reference.

The essential component of both Class (1) and Class (2) compositions is an oxidizing agent i.e., a material that will readily react or burn when mixed with the decahydrodecaborate (−2) salt. Any solid oxidizing agent which will yield oxygen upon decomposition will fulfill this role; solid oxygen containing metal or nonmetal salts are preferred because of their availability, stability, and ease of incorporation into the composition. Solid oxidizing agents useful in Class (2) must meet certain solubility criteria, as listed in the referenced description of the coprecipitation process.

In general, solid oxidizing agents include ammonium, substituted ammonium, gaunidine, substituted guanidine, alkali and alkaline-earth salts of oxygen containing acids such as nitric, perchloric, permanganic, manganic, chromic, and dichromic acids. Preferred species for this invention, which gave good thermal stability and low hygroscopicity include ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate. Other solid oxidizing agents which could be used if the appropriate solvent/nonsolvent system were used include ammonium, substituted ammonium, guanidine, substituted guanidine, alkali and alkaline-earth salts of other oxygen-containing acids such as chloric, persulfuric, thiosulfuric, periodic, iodic and bromic acids. Other stable oxidizers include lead thiocyanate, the oxides and peroxides of the light and heavy metals and nonmetals, such as barium peroxide, lead peroxide ($PbO_2$), lithium peroxide, ferric oxide, red lead ($Pb_3O_4$), cupric oxide, tellurium dioxide, antimonic oxide, etc., and nonionic substances such as nitrocellulose, nitroguanidine, and cyclotetramethylenetetranitramine (HMX). Mixtures of the aforementioned oxidizing agents can also be used.

Optionally, additives to both Class (1) and (2) compositions may be employed to alter the processing, handling, or other properties of the mix. These may include binders such as caesin, gum arabic, dextrins, waxes, polymeric materials such as polyurethanes, epoxies, natural or synthetic rubbers, copolymers of a rubber and plastic such as styrene-butadiene, methyl cellulose, and nitrocellulose. Polyethylene glycol of average molecular weight 4000 is a preferred species. These optional ingredients would commonly be used in concentrations up to 8% by weight of the total weight of the pyrotechnic materials used as taught herein.

The pyrotechnic compounds taught herein preferably have the particular salts of decahydrodecaboric acid constituting from between approximately 6–30% by weight of the total pyrotechnic compound. With respect to the simple nonmetallic salts, critical mole ratios of salt to oxidizer have been discovered, as further elaborated upon in the copending application Ser. No. 694,625, previously incorporated by reference herein.

A convenient method of packaging the decahydrodecaborate salt pyrotechnic compositions for incorporation into the subject ignition devices is to first clad the pyrotechnic composition within a metal tube to form a linear cord, in a manner identical with that described for sheathing the high explosive detonating cords. Multiple cords of the pyrotechnic material can then be used to fabricate the subject device, by laying or spiraling the pyrotechnic cords around the central explosive cord. Lead is a preferred cladding metal; pyrotechnic core loads between 3 and 80 grains of composition per linear foot and mass ratios between 8 and 35 are preferred for pyrotechnic cords taught for the subject ignition devices.

As has been noted, the present invention significantly requires an intimate juxtapositioning of the subject pyrotechnics around the sheathed detonating high explosive cord. Hence, a consideration of an exemplary manufacturing procedure is helpful to a further understanding of the present invention.

Manufacture of Ignition Devices

The method of manufacturing the subject ignitor devices is critical to their successful function. The principle of operation of the device requires that the explosive stimulus shatter the layer or layers of sheathing materials separating the explosive materials from the pyrotechnic material, and either by shock or flame stimulus, ignite the pyrotechnic materials. This requirement can be embodied in a cord in which the successive layers of material — central explosive composition, layer or layers of sheathing material, and pyrotechnic composition are in intimate contact, and the sheathing layer is thin enough to shatter or effectively transmit the explosive shock and accompanying flame to the pyrotechnic material.

A preferred method of manufacturing the subject devices which fulfills the forementioned requirement, consists of first assembling a bundle consisting of a central explosive cord, which may be of an extruded or metal sheathed configuration, as described above, and surrounding it with several cords, consisting of metal clad decahydrodecaborate pyrotechnic materials as defined above. The pyrotechnic cords may be extended in a linear form along the central explosive cord. The number of cords is not critical, but the number must be sufficient to incorporate the desired distribution of pyrotechnic in the final device; in general, for ease of handling, more than three and less than 13 cords are preferred. The method of assembling the pyrotechnic cords around the central core is determined somewhat by the diameters of the pyrotechnic cords and the central cord, and it is essential that each of the pyrotechnic cords be in intimate contact with the explosive along its full length. This requirement eliminates, for example, such configurations as those made by braiding the pyrotechnic cords around the central cord.

Figure 4:
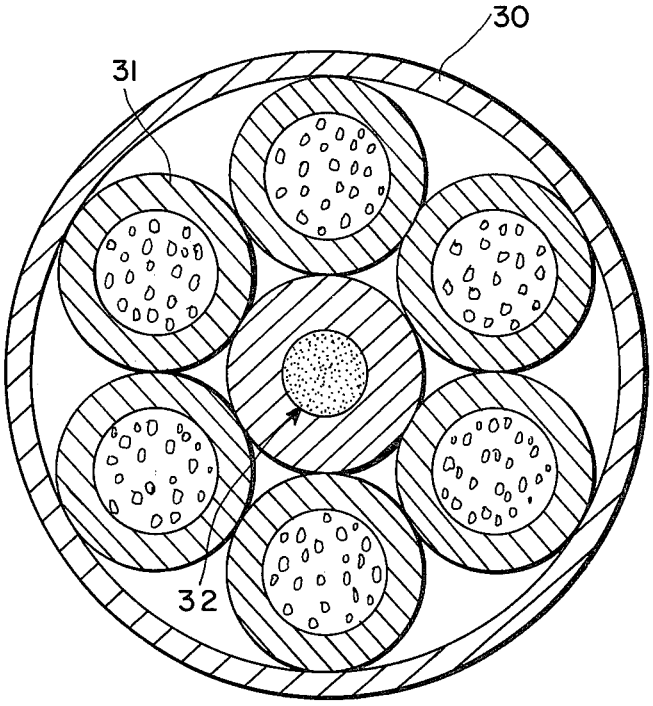

The critical manufacturing step in this and other methods of manufacturing the subject devices consists in achieving a cross-sectional area reduction on the assembled bundle, so that the pyrotechnic cladding and explosive cord sheath are brought into very intimate contact, in essence, fused together. FIG. 4 illustrates that a convenient way of bringing about the area reduction is to place a number of metal clad pyrotechnic cords 31 about sheathed detonating cord 32, and fit this bundle inside a tightly fitting outer tube of a metal, such as lead, aluminum, or silver, as shown at 30. The pyrotechnic cords 31 are preferably spiraled about cord 32. The tube and bundle assembly is then swaged or drawn through a series of dies such that the cross-sectional area of the assembly is reduced, for example to the configuration 34 shown in FIG. 5. The area reduction results in deformation and elongation of the bundle inside the tube, bringing the respective explosive sheathing layer and pyrotechnic cladding layers into very tight contact. Preferred area reductions which will accomplish the required compaction and deformation are 10 to 60%. The configuration 34 may include the tube 30, or the tube 30 may be removed to leave a metallic matrix of the sheathing, cladding, explosive and pyrotechnic.

An alternate method of providing the required area reduction consists of drawing or swaging the assembled cord bundle through a series of dies without using a metal tube as an additional outer cladding cover. In this form, a layer of glass or fabric, such as 36 in FIG. 5, may then be braided over the external surface of the finished device, or alternately, an extruded plastic layer may be applied on the outer surface. Such an outer covering or encapsulment is required only to protect or hold the assembly together; the radial deflagration phenomenon derives from the unique pyrotechnic materials themselves. This latter method of manufacture is preferred when a low metal content is desired for the finished device, such as for use in large caliber gun ignitors or where light weight in the device is a system requirement.

FIG. 6 illustrates, in a sectional view, spirals of pyrotechnic, 38, around the sheathed detonating cord, with metallic cladding 40 fused between respective spirals.

The cross-sectional configuration of the finished device is not critical, and can be altered by the cross-sectional configuration of the dies used to produce the final device. Examples of geometric cross-sectional shapes which are satisfactory for the subject devices include round, square, oval, or hexagonal.

Other methods of manufacture of the subject devices which bring about the required intimacy of the individual components will be evident to those practiced in the art of assembly of linear and cord explosive and pyrotechnic devices, and the above method of manufacture is not intended to be limiting. For example, the subject devices could alternatively be manufactured by suspending the explosive central cord concentrically in a metal tube whose inside diameter is larger than the outside diameter of the central cord, and the void formed by these surfaces filled with the decahydrodecaborate pyrotechnic material. Spacers inserted at intervals, as the pyrotechnic material is loaded, could serve to support the central cord and improve uniformity of the pyrotechnic loading. The loaded assembly would then be capped and drawn through a series of dies until the desired compaction and area reduction is achieved.

Alternately, one could start with a metal tube whose cross-sectional area resembles a wagon wheel, i.e., with a central "hub" or enclosed aperture into which the explosive material is introduced with a series of outer apertures, mutually separated from each other by the "spokes" into which the pyrotechnic material is loaded. The assembly is capped and the area reduced in the same manner as described above, in order to achieve the required intimate compaction of all the components within the resultant matrix defining the present invention.

It should be noted that the area reduction is considered necessary for all configurations and embodiments, and specific examples now follow to further illustrate manufacturing principles and resultant ignition functions according to the various embodiments of the present invention.

Through the following examples, the significant parameters of the present invention are illustrated. In each example the detonating cords and pyrotechnic cords are referenced to their respective linear distributions and mass ratios. It should be noted that the initial outer diameters of the various high explosive detonating cords, and the initial outer diameters and numbers of concentrically arranged pyrotechnic cords are not particularly critical.

In the following examples, the detonating cords had initial outer diameters of approximately 0.080 inches. The metal-clad pyrotechnic cords had initial outer diameters in the range 0.080 to 0.125 inches. Of course, the definition of either component by linear distribution, of explosive or pyrotechnic material, and its associated mass ratio practically defines the approximate outer diameters. During the mechanical forming manufacturing step, the metal cladding is radically compressed upon the respective crystalline explosive and pyrotechnic components, increasing their respective densities, without effecting the overall mass ratios of each component at all. The area reduction mechanism is the results in the filling of any initial voids to create an intimate metallic matrix around substantially compacted explosive and pyrotechnic volumes.

EXAMPLE I

A bundle consisting of one central denotating high-explosive cord of lead sheathed RDX, 2.5 grains per linear foot and mass ratio 42, is surrounded by 6 lead clad pyrotechnic cords containing 25%-by-weight cesium decahydrodecaborate coprecipitated with 75%-by-weight potassium nitrate, 12.5 grains per linear foot and of mass ratio 15. The pyrotechnic cords are positioned linearly along the explosive cord length and inserted inside a lead tube of outside diameter 0.628 inches, simply, to act as a further outer encapsulment for the assembly. The cord and tube assembly is swaged to an outside diameter of 0.532 inches, corresponding to an area reduction of 28%. The finished assembly inside the tube is approximately 18 inches long, with 8 inch leads of all the cords protruding from both ends. The above-noted linear distributions of explosive and pyrotechnic materials remained substantially constant through the area reduction.

The unit is securely mounted on a test stand. The pyrotechnic cords on one end of the unit are capped and shielded from the explosive cord ends by an aluminum plate, such that the uncapped end of the explosive cad protrudes through a hole in the plate while the pyrotechnic cords remain behind the plate. The purpose of the plate is to shield the pyrotechnic lines from the detonator and explosive cord flash, to demonstrate that the lines ignited inside the swaged tube by the confined explosive impetus. A number 8 detonating cap is attached to the protruding explosive cord.

The unit is functioned by remotely detonating the cap. High speed motion picture photography demonstrates that the unit has a linear propagation in excess of 5400 meters per second, characteristic of the RDX detonation front speed, and has a radial expansion of approximately 250 meters per second (9800 inches per second), characteristic of the decahydrodecaborate deflagration speed. Post fire examination of the remains show that all the pyrotechnic cords have completely ignited. Several small fragments of the outer encapsulating tube remain.

EXAMPLE II

A bundle consisting of one central detonating high-explosive cord of lead sheathed RDX, 2.4 grains per linear foot and mass ratio 42, is surrounded by 5 lead clad pyrotechnic cords containing 15%-by-weight bis-tetramethylammonium decahydrodecaborate coprecipitated with 85%-by-weight potassium nitrate, 15 grains per linear foot and of mass ratio 12. The pyrotechnic cords are spiraled around the explosive cord length and inserted inside a lead tube of outside diameter 0.455 inches which serves as an outer encapsulment. The cord and tube assembly is swaged to an outside diameter of 0.348 inches, corresponding to an area reduction of 42%. The finished assembly inside the outer tube is approximately 18 inches long, with 8 inch leads of all the cords protruding from both ends.

The unit is tested in a manner identical with Example I. All pyrotechnic cords function completely. Several small fragments of the outer encapsulation remain. The event is characterized audially by a loud "crack," indicating to those practiced in the art that the effective event was a deflagration rather than a detonation.

EXAMPLE III

A bundle consisting of one central detonating high-explosive cord of lead sheathed RDX, 2.5 grains per linear foot and mass ratio 42, is surrounded by 6 lead clad pyrotechnic cords containing 25%-by-weight cesium decahydrodecaborate coprecipitated with 75%-by-weight potassium nitrate, 12.5 grains per linear foot and of mass ratio 15. The pyrotechnic cords are arranged linearly along the explosive cord length and inserted inside an encapsulment tube of aluminum, of outer diameter 0.500 inches. The cord and tube assembly is swaged to an outside diameter of 0.401 inches, corresponding to an area reduction of 36%. The finished assembly inside the tube is approximately 12 inches long, with 8 inch leads of all the cords protruding from both ends.

The unit is tested in a manner identical with Example I. All pyrotechnic cords function completely. The outer aluminum excapsulating layer is ruptured. High speed motion picture photography indicates the linear propagation speed is that characteristic of a detonation.

EXAMPLE IV

A bundle consisting of one central detonating high-explosive cord of lead sheathed HNS, 4.1 grains per linear foot and mass ratio 44, is surrounded by 5 lead-clad pyrotechnic cords, each containing 15%-by-weight bis-tetramethylammonium decahydrodecaborate coprecipitated with 75%-by-weight potassium nitrate, 27 grains per linear foot and mass ratio 8. The pyrotechnic cords are spiraled around the central cord explosive length and held in place with tape. The taped assembly is drawn through a square die to a dimension 0.200 inch on a side. The area reduction is 48%. The drawn assembly is then braided over its exterior surface with a tight braid of fiberglass in a loose (open) weave. This form of outer encapsulment is used merely to protect the igniter configuration. Eight inches of each of the cords protrudes from the end of the finished assembly, which is approximately 18 inches long.

The unit is mounted in a test fixture in a manner identical with Example I except that a chicken wire screen envelopes the entire assembly to capture any fragments that may remain after function.

The unit is tested in a manner identical with Example I. High speed motion picture photography confirms that the longitudinal propagation velocity is in excess of 6000 meters per second and the radial expansion approximately 250 meters per second. No fragments of any kind remain in the test setup, indicating that the unit functioned completely, vaporizing the lead matrix as well as all of the outer encapsulating materials. This example illustrates functioning of the preferred embodiment of the invention, as illustrated in FIG. 3 of the drawings.

EXAMPLE V

A 36 inch length of lead sheathed RDX, 2.5 grains per foot and mass ratio 42, is taped tightly on an aluminum plate against an aluminum clad pyrotechnic cord containing 25%-by-weight cesium decahydrodecaborate coprecipitated with 75%-by-weight potassium nitrate, 12 grains per linear foot and mass ratio 14. The ends of the pyrotechnic cord are coated with an epoxy and shielded from the ends of the explosive cord. A number 8 detonating cap is attached to the explosive cord and detonated.

The detonating cap is functioned remotely. The explosive cord functions completely. The pyrotechnic cord fails to ignite. The test demonstrates that the explosive and pyrotechnic cords must be brought into intimate contact by a drawing or swaging process as a requirement for successful manufacture of the devices taught by the present invention.

EXAMPLE VI

A bundle consisting of one central cord of lead sheathed HNS, 4.1 grains per linear foot and mass ratio 42, is surrounded by 6 lead-clad pyrotechnic cords containing 15%-by-weight bis-tetramethylammonium decahydrodecaborate which has been coprecipitated with 85%-by-weight potassium nitrate as taught herein. Each cord has a pyrotechnic distribution of 7.3 grains per linear foot and a mass ratio of 35. The pyrotechnic cords are spiraled around the explosive cord length and inserted inside a lead tube of outside diameter 0.628 inches. The cord and tube assembly is swaged to an outside diameter of 0.532 inches, corresponding to an area reduction of 28%. The finished assembly inside the tube is approximately 18 inches long, with 8 inch leads of all the cords protruding from both ends.

The unit is tested in a manner identical with Example I. Four of the pyrotechnic lines fail to function and the lead tube fails to rupture. The test places an upper limit on the mass ratio of the pyrotechnic cord and a lower limit on the distribution of explosive HNS material.

EXAMPLE VII

A bundle consisting of one central cord of lead sheathed RDX, 2.5 grains per linear foot and mass ratio 42, is surrounded by 6 lead-clad pyrotechnic cords containing 15%-by-weight bis-tetramethylammonium coprecipitated with 85%-by-weight potassium nitrate, 7.3 grains per linear foot and of mass ratio 35. The pyrotechnic cords are braided around the explosive cord length and inserted inside a lead tube of outside diameter 0.750 inches. The cord and tube assembly is swaged to an outside diameter of 0.532 inches, corresponding to an area reduction of 49%. The finished assembly inside the tube is approximately 18 inches long, with 8 inch leads of all the cords protruding from both ends.

The unit is tested in a manner identical with Example I. Two of the pyrotechnic cords fail to function completely. In several locations the lead tube ruptures. In one rupture, examination of the functioned unit reveals that all six pyrotechnic lines have been ignited at one point but one has failed to propagate. The break in the pyrotechnic cord was at a point on the cord braid where the failed line overlapped another (functioned) line, i.e., the pyrotechnic line was not in intimate contact with the explosive cord at the failure point.

The test demonstrates that the pyrotechnic line must be in intimate contact with the explosive cord over its entire length.

Having described various embodiments of our invention, it is understood that the invention is to be limited only by the scope of the appended claims.

We claim:

1. In an igniter device comprising a centrally disposed high explosive which is linearly encapsulated, the improvement comprising a linear distribution of metal cladded pyrotechnic material about said encapsulation and in intimate contact therewith, wherein said pyrotechnic material includes an oxidizing agent combined with a simple decahydrodecaborate salt, having the common anion $B_{10}H_{10}^{-2}$ wherein the cation is selected from the group consisting of:

i. ammonium, wherein the salt has the formula $(NH_4)_2B_{10}H_{10}$;

ii. hydrazinium, wherein the salt has the general formula $(NH_2NH_3)\ B_{10}H_{10}$;

iii. substituted ammonium cations, wherein the salt has the general formula $(R_3NH)_2B_{10}H_{10}$, wherein further R is selected from the group consisting of hydrogen and alkyl radicals containing less than six carbon atoms;

iv. substituted hydrazinium cations, wherein the salt has the general formula $(R_2NNR_2H)_2B_{10}H_{10}$ wherein further R is selected from the group consisting of hydrogen and alkyl radicals containing less than six atoms.

2. In an igniter device comprising a centrally disposed high explosive which is linearly encapsulated, the improvement comprising a linear distribution of metal cladded pyrotechnic material about said encapsulation and in intimate contact therewith, wherein said pyrotechnic material includes an oxidizing agent combined with a simple decahydrodecaborate salt, having the common anion $B_{10}H_{10}^{-2}$ wherein the cation is selected from the group consisting of:

i. tetramethylammonium $(CH_3)_4N+$, tetraethylammonium $(CH_3CH_2)_4N+$, and quaternary ammonium cations having the general formula $R_4N+$ where R is an alkyl radical;

ii. pyridinium, bipyridinium aryl-diazonium, aryl containing cations and substituted aryl containing cations.

3. In an igniter device comprising a centrally disposed high explosive which is linearly encapsulated, the improvement comprising a linear distribution of metal cladded pyrotechnic material about said encapsulation and in intimate contact therewith, wherein said pyrotechnic material includes an oxidizing agent combined with a simple decahydrodecaborate salt, having the anion $B_{10}H_{10}^{-2}$, wherein the cation is guanidinium, and the salt has the formula $(C(NH_2)_3)_2B_{10}H_{10}$.

4. In an igniter device comprising a centrally disposed high explosive which is linearly encapsulated, the improvement comprising a linear distribution of metal cladded pyrotechnic material about said encapsulation and in intimate contact therewith, wherein said pyrotechnic material includes an oxidizing agent combined with a simple metallic decahydrodecaborate salt, having the common anion $B_{10}H_{10}^{-2}$, wherein the cation is selected from the group consisting of:

i. metal ions derived from the elements in Groups 1, 2, 8, 3*b*, 4*b*, 5*b*, 6*b*, 7*b*, and the elements of Groups 3*a*, 4*a*, 5*a*, and 6*a* which have atomic numbers respectively greater than 5, 14, 33 and 52.

5. An igniter device as in claim 1 wherein said device has a final configuration which is the resultant product of a process wherein an initial cross-sectional area of said igniter is radially reduced by a mechanical forming step which compacts said metal cladding radially inwardly to define a final cross-sectional area for said device which is reduced approximately 10–60 percent from said initial cross-sectional area.

6. An igniter device as in claim 5 wherein said metal cladding on said pyrotechnic is one selected from the group consisting of lead, aluminum and silver, and said simple decahydrodecaborate salt selected comprises approximately 6–30% by weight of said pyrotechnic material.

7. An igniter device as in claim 6 wherein said centrally disposed high explosive is selected from the group consisting of cyclotrimethylenetrinitramine (RDX), cyclotetramethylenetetranitramine (beta-HMX), pentaerythritol (PETN), hexanitrostilbene (HNS), and dipicramid (DIPAM), and said linear encapsulation comprises a sheath around said explosive.

8. An igniter device as in claim 7 wherein said high explosive sheath, and said metal cladding on said pyrotechnic material, are of lead, and said detonating cord has a distribution of high explosive of between approximately 2 to 6 grains per lineal foot and a mass ratio of lead to high explosive of between approximately 50 to 12, by weight.

9. An igniter device as in claim 5 wherein said pyrotechnic material includes an oxidizer selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

10. An igniter device as in claim 5 wherein said device further comprises a plurality of individual metal-clad pyrotechnic cords concentrically arranged about, and linearly extending along, said encapsulated explosive wherein said individual metal clad pyrotechnic cords are fused into a metallic matrix around said high explosive by said forming step.

11. An igniter device as in claim 5 wherein said pyrotechnic material is further the resultant product of a coprecipitation of one of said group of simple decahydrodecaborate salts, and said solid oxidizing agent, by the process of:

i. dissolving both the decahydrodecaborate (−2) salt and the solid oxidizing agent in a mutually soluble solvent, at a temperature sufficiently high to maintain said salt and said oxidizing agent in solution;

ii. forming a pressurized stream of said solution and brining said solution stream together with a pressurized stream of a miscible nonsolvent, under conditions of extreme turbulence within a mixing chamber, to effect a substantially complete coprecipitation;

iii. recovering the coprecipitated product by filtering the effluent from said mixing chamber, and washing said product with an inert and nonsolvent fluid;

iv. drying the product to remove all remaining liquid.

12. An igniter device as in claim 11 wherein said coprecipitated oxidizing agent is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

13. An igniter device as in claim 12 wherein said device further comprises a plurality of individual metal-clad pyrotechnic cords concentrically arranged about, and linearly extending along, said encapsulated explosive wherein said individual metal clad pyrotechnic cords are fused into a metallic matrix around said high explosive by said forming step.

14. An igniter device as in claim 10 wherein said plurality of metal clad pyrotechnic cords is between 3 and 13.

15. An igniter device as in claim 13 wherein said plurality of metal clad pyrotechnic cords is between 3 and 13.

16. An igniter device as in claim 14 wherein said linear encapsulation comprises an outer sheath, and said sheath and said metal cladding on each of said pyrotechnic cords are of lead, wherein further said detonating cord has a distribution of high explosive of between approximately 2 to 6 grains per lineal foot and a mass ratio of lead to high explosive of between approximately 50 to 12, by weight, and each protechnic cord has a distribution of said pyrotechnic of between approximately 3 to 80 grains per lineal foot and a mass ratio of lead to pyrotechnic material of between approximately 3 to 35, by weight.

17. An igniter device as in claim 6 wherein said centrally disposed and linearly encapsulated explosive comprises a flexible extended cord of explosive particles within a viscoelastic binder.

18. An igniter device as in claim 17 wherein said flexible extruded cord further includes an additional sheathing defined by a separate outer layer of plastic material.

19. An igniter device as in claim 6 wherein said initial cross section of said igniter is further defined by an additional layer of an encapsulating material as an outer covering.

20. An igniter device as in claim 2 wherein said device has a final configuration which is the resultant product of a process wherein an initial cross-sectional area of said igniter is radially reduced by a mechanical forming step which compacts said metal cladding radially inwardly to define a final cross-sectional area for said device which is reduced approximately 10–60 percent from said initial cross-sectional area.

21. An igniter device as in claim 20 wherein said metal cladding on said pyrotechnic is one selected from the group consisting of lead, aluminum and silver, and said simple decahydrodecaborate salt selected comprises approximately 6–30% by weight of said pyrotechnic material, and the cation is further selected from the group consisting of tetramethyl ammonium, tetra ethyl ammonium, pyridinium and aryl-diazonium cations.

22. An igniter device as in claim 21 wherein said centrally disposed high explosive is selected from the group consisting of cyclotrimethylenetrinitramine (RDX), cyclotetramethylenetetranitramine (beta-HMX), pentaerythritol (PETN), hexanitrostilbene (HNS), and dipicramid (DIPAM), and said linear encapsulation comprises a sheath around said explosive.

23. An igniter device as in claim 22 wherein said high explosive sheath, and said metal cladding on said pyrotechnic material, are of lead, and said detonating cord has a distribution of high explosive of between approximately 2 to 6 grams per lineal foot and a mass ratio of lead to high explosive of between approximately 50 to 12, by weight.

24. An igniter device as in claim 20 wherein said pyrotechnic material includes an oxidizer selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

25. An igniter device as in claim 20 wherein said device further comprises a plurality of individual metal-clad pyrotechnic cords concentrically arranged about, and linearly extending along, said encapsulated explosive wherein said individual metal clad pyrotechnic cords are fused into a metallic matrix around said high explosive by said forming step.

26. An igniter device as in claim 20 wherein said pyrotechnic material is further the resultant product of a coprecipitation of one of said group of simple decahydrodecarbonate salts, and said solid oxidizing agent, by the process of:

i. dissolving both the decahydrodecaborate (−2) salt and the solid oxidizing agent in a mutually soluble solvent, at a temperature sufficiently high to maintain said salt and said oxidizing agent in solution;

ii. forming a pressurized stream of said solution and brining said solution stream together with a pressurized stream of a miscible nonsolvent, under conditions of extreme turbulence within a mixing chamber, to effect a substantially complete coprecipitation;

iii. recovering the coprecipitated product by filtering the effluent from said mixing chamber, and washing said product with an inert and nonsolvent fluid;

iv. drying the product to remove all remaining liquid.

27. An igniter device as in claim 26 wherein said coprecipitated oxidizing agent is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

28. An igniter device as in claim 27 wherein said device further comprises a plurality of individual metal-clad pyrotechnic cords concentrically arranged about, and linearly extending along, said encapsulated explosive wherein said individual metal clad pyrotechnic cords are fused into a metallic matrix around said high explosive by said forming step.

29. An igniter device as in claim 25 wherein said plurality of metal clad pyrotechnic cords is between 3 and 13.

30. An igniter device as in claim 28 wherein said plurality of metal clad pyrotechnic cords is between 3 and 13.

31. An igniter device as in claim 29 wherein said linear encapsulation comprises an outer sheath, and said metal cladding on each of said pyrotechnic cords, are of lead, wherein further said detonating cord has a distribution of high explosive of between approximately 2 to 6 grains per lineal foot and a mass ratio of lead to high explosive of between approximately 50 to 12, by weight, each pyrotechnic cord has a distribution of said pyrotechnic of between approximately 33 to 80 grains per lineal foot and a mass ratio of lead to pyrotechnic material of between approximately 8 to 35, by weight.

32. An igniter device as in claim 21 wherein said centrally disposed and linearly encapsulated explosive comprises a flexible extruded cord of explosive particles within a viscoelastic binder.

33. An igniter device as in claim 32 wherein said flexible extruded cord further includes an additional sheathing defined by a separate outer layer of plastic material.

34. An igniter device as in claim 21 wherein said initial cross section of said igniter is further defined by an additional layer of an encapsulating material as an outer covering.

35. An igniter device as in claim 3 wherein said device has a final configuration which is the resultant product of a process wherein an initial cross-sectional area of said igniter is radially reduced by a mechanical forming step which compacts said metal cladding radially inwardly to define a final cross-sectional area for said device which is reduced approximately 10–60 percent from said initial cross-sectional area.

36. An igniter device as in claim 35 wherein said metal cladding on said pyrotechnic is one selected from the group consisting of lead, aluminum and silver, and said simple decahydrodecaborate salt selected comprises approximately 6–30% by weight of said pyrotechnic material.

37. An igniter device as in claim 36 wherein said centrally disposed high explosive is selected from the group consisting of cyclotrimethylenetrinitramine (RDX), cyclotetramethylenetetranitramine (beta-HMX), pentaerythritol (PETN), hexanitrostilbene (HNS), and dipicramid (DIPAM), and said linear encapsulation comprises a sheath around said explosive.

38. An igniter device as in claim 37 wherein said high explosive sheath, and said metal cladding on said pyrotechnic material, are of lead, and said detonating cord has a distribution of high explosive of between approximately 2 to 6 grains per lineal foot and a mass ratio of lead to high explosive of between approximately 50 to 12, by weight.

39. An igniter device as in claim 35 wherein said pyrotechnic material includes an oxidizer selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

40. An igniter device as in claim 35 wherein said device further comprises a plurality of individual metal-clad pyrotechnic cords concentrically arranged about, and linearly extending along, said encapsulated explosive wherein said individual metal clad pyrotechnic cords are fused into a metallic matrix around said high explosive by said forming step.

41. An igniter device as in claim 35 wherein said pyrotechnic material is further the resultant product of a coprecipitation of one of said group of simple decahydrodecaborate salts, and said solid oxidizing agent, by the process of:

i. dissolving both the decahydrodecaborate (−2) salt and the solid oxidizing agent in a mutually soluble solvent, at a temperature sufficiently high to maintain said salt and said oxidizing agent in solution;

ii. forming a pressurized stream of said solution and brining said solution stream together with a pressurized stream of a miscible nonsolvent, under conditions of extreme turbulence within a mixing chamber, to effect a substantially complete coprecipitation;

iii. recovering the coprecipitated product by filtering the effluent from said mixing chamber, and washing said product with an inert and nonsolvent fluid;

iv. drying the product to remove all remaining liquid.

42. An igniter device as in claim 41 wherein said coprecipitated oxidizing agent is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

43. An igniter device as in claim 42 wherein said device further comprises a plurality of individual metal-clad pyrotechnic cords concentrically arranged about, and linearly extending along, said encapsulated explosive wherein said individual metal clad pyrotechnic cords are fused into a metallic matrix around said high explosive by said forming step.

44. An igniter device as in claim 40 wherein said plurality of metal clad pyrotechnic cords is between 3 and 13.

45. An igniter device as in claim 43 wherein said plurality of metal clad pyrotechnic cords is between 3 and 13.

46. An igniter device as in claim 44 wherein said linear encapsulation comprises an outer said sheath and said metal cladding on each of said pyrotechnic cords, are of lead, wherein further said detonating cord has a distribution of high explosive of between approximately 2 to 6 grains per lineal foot and a mass ratio of lead to high explosive of between approximately 50 to 12, by weight, and each pyrotechnic cord has a distribution of said pyrotechnic of between approximately 3 to 80 grains per lineal foot and a mass ratio of lead to pyrotechnic material of between approximately 8 to 35, by weight.

47. An igniter device as in claim 36 wherein said centrally explosive disposed and linearly encapsulated explosive comprises a flexible extruded cord of explosive particles within a viscoelastic binder.

48. An igniter device as in claim 47 wherein said flexible extruded cord further includes an additional sheathing defined by a separate outer layer of plastic material.

49. An igniter device as in claim 36 wherein said initial cross section of said igniter is further defined by an additional layer of an ecapsulating material as an outer covering.

50. An igniter device as in claim 4 wherein said device has a final configuration which is the resultant product of a process wherein an initial cross-sectional area of said igniter is radially reduced by a mechanical forming step which compacts said metal cladding radially inwardly to define a final cross-sectional area for said device which is reduced approximately 10–60 percent from said initial cross-sectional area.

51. An igniter device as in claim 50 wherein said metal cladding on said pyrotechnic is one selected from the group consisting of lead, aluminum and silver, wherein the metallic salt is selected from the group consisting of cesium decahydrodecaborate, $Cs_2B_{10}H_{10}$, and potassium decahydrodecaborate, $K_2B_{10}H_{10}$, and comprises approximately 6–30% by weight of said pyrotechnic material.

52. An igniter device as in claim 51 wherein said centrally disposed high explosive is selected from the group consisting of cyclotrimethylenetrinitramine (RDX), cyclotetramethylenetetranitramine (beta-HMX), pentaerythritol (PETN), hexanitrostilbene (HNS), and dipicramid (DIPAM), and said linear encapsulation comprises a sheath around said explosive.

53. An igniter device as in claim 52 wherein said high explosive sheath, and said metal cladding on said pyrotechnic material, are of lead, and said detonating cord has a distribution of high explosive of between approximately 2 to 6 grains per lineal foot and a mass ratio of lead to high explosive of between approximately 50 to 12, by weight.

54. An igniter device as in claim 50 wherein said pyrotechnic material includes an oxidizer selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetrametylammonium nitrate and cesium nitrate.

55. An igniter device as in claim 50 wherein said device further comprises a plurality of individual metal-clad pyrotechnic cords concentrically arranged about, and linearly extending along, said encapsulated explosive wherein said individual metal clad pyrotechnic cords are fused into a metallic matrix around said high explosive by said forming step.

56. An igniter device as in claim 50 wherein said pyrotechnic material is further the resultant product of a coprecipitation of one of said group of simple decahydrodecaborate salts, and said solid oxidizing agent, by the process of:

i. dissolving both the decahydrodecaborate (−2) salt and the solid oxidizing agent in a mutually soluble solvent, at a temperature sufficiently high to maintain said salt and said oxidizing agent in solution;
ii. forming a pressurized stream of said solution and brining said solution stream together with a pressurized stream of a miscible nonsolvent, under conditions of extreme turbulence within a mixing chamber, to effect a substantially complete coprecipitation;
iii. recovering the coprecipitated product by filtering the effluent from said mixing chamber, and washing said product with an inert and nonsolvent fluid;
iv. drying the product to remove all remaining liquid.

57. An igniter device as in claim 56 wherein said coprecipitated oxidizing agent is selected from the group consisting of ammonium nitrate, potassium nitrate, potassium perchlorate, ammonium perchlorate, guanidine nitrate, triaminoguanidine nitrate, potassium permanganate, sodium chromate, barium nitrate, barium chromate, barium manganate, sodium dichromate, tetramethylammonium nitrate and cesium nitrate.

58. An igniter device as in claim 57 wherein said device further comprises a plurality of individual metal-clad pyrotechnic cords concentrically arranged about, and linearly extending along, said encapsulated explosive wherein said individual metal clad pyrotechnic cords are fused into a metallic matrix around said high explosive by said forming step.

59. An igniter device as in claim 55 wherein said plurality of metal clad pyrotechnic cords is between 3 and 13.

60. An igniter device as in claim 58 wherein said plurality of metal clad pyrotechnic cords is between 3 and 13.

61. An igniter device as in claim 59 wherein said linear encapsulation comprises an outer sheath, and said sheath and said metal cladding on each of said pyrotechnic cords, are of lead, wherein further said detonating cord has a distribution of high explosive of between approximately 2 to 6 grains per lineal foot and a mass ratio of lead to high explosive of between approximately 50 to 12, by weight, each pyrotechnic cord has a distribution of said pyrotechnic of between approximately 3 to 80 grains per lineal foot and a mass ratio of lead to pyrotechnic material of between approximately 8 to 35, by weight.

62. An igniter device as in claim 51 wherein said centrally disposed and linearly encapsulated explosive comprises a flexible extruded cord of explosive particles within a viscoelastic binder.

63. An igniter device as in claim 62 wherein said flexible extruded cord further includes an additional sheathing defined by a separate outer layer of plastic material.

64. An igniter device as in claim 51 wherein said initial cross section of said igniter is further defined by an additional layer of an encapsulating material as an outer covering.

* * * * *